US008316489B1

(12) United States Patent
Leal

(10) Patent No.: US 8,316,489 B1
(45) Date of Patent: Nov. 27, 2012

(54) ORTHOPAEDIC PILLOW FRAME

(76) Inventor: Silviano Leal, Lodi, NJ (US)

( * ) Notice: Subject to any disclaimer, the term of this patent is extended or adjusted under 35 U.S.C. 154(b) by 0 days.

(21) Appl. No.: 13/528,110

(22) Filed: Jun. 20, 2012

(51) Int. Cl.
*A47G 9/00* (2006.01)

(52) U.S. Cl. ..... 5/643; 5/640; 5/657

(58) Field of Classification Search ..... 5/643, 630, 5/636, 640, 657
See application file for complete search history.

(56) References Cited

U.S. PATENT DOCUMENTS 2,940,087 A 6/1960 Kiefer
3,258,790 A * 7/1966 Maru ..... 5/636
3,403,413 A * 10/1968 Calhoun et al. ..... 5/638
4,494,261 A 1/1985 Morrow
4,617,691 A 10/1986 Monti et al.
4,756,035 A 7/1988 Beier
5,025,518 A 6/1991 Summer
D394,977 S 6/1998 Frydman
2006/0282952 A1* 12/2006 Laxton ..... 5/636
2007/0118991 A1* 5/2007 Nakayama ..... 5/640

* cited by examiner

*Primary Examiner* — Fredrick Conley

(57) ABSTRACT

An orthopedic pillow frame effective for facilitating the ideal position of the human head on a pillow while the body is at a resting position comprising in some embodiments primary and complimentary arcs, primary and complimentary inverted arcs, primary and complimentary side bars, a bottom platform, and where the various components are oriented around a first plane and a second plane.

7 Claims, 4 Drawing Sheets

ISO W/COVER ON

ISO FRAME/COVER REMOVED

SECTION

TOP VIEW/FRAME

SIDE VIEW/FRAME

END VIEW/FRAME

ORTHOPAEDIC PILLOW FRAME

BACKGROUND OF THE INVENTION

The present invention relates generally to orthopedic and ergonomic pillows and pillow devices. More specifically, the present invention relates to frame systems for supporting said pillows.

Scientists and other authorities have generally opined that the average person should attempt to achieve at least 8 hours of sleep per day in order to maximize health and performance generally and in the workplace. Sleep, and more importantly, effective and REM ("Rapid Eye Movement") sleep, without snoring or other issues, is thus clearly an important part of human life.

While there are a number of pillows available to the public which purport to assist with sleep and comfort, it is believed that the public and the prior art lacks a pillow frame which can both increase sleep potential and also reduce snoring.

Therefore, It is believed that there is a need for an improved pillow frame which can achieve just that: maximization of healthy sleep while at the same time reducing snoring.

SUMMARY

The present invention features a pillow frame which is carefully designed to maximize sleep and reduce snoring. In some embodiments, the frame comprises primary and complimentary arcs, primary and complimentary inverted arcs, a bottom platform, and primary and complimentary side bars.

In some embodiments, the aforementioned features can be oriented around a first plane and a second plane. In some embodiments, one or all of the aforementioned features make contact with each other.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
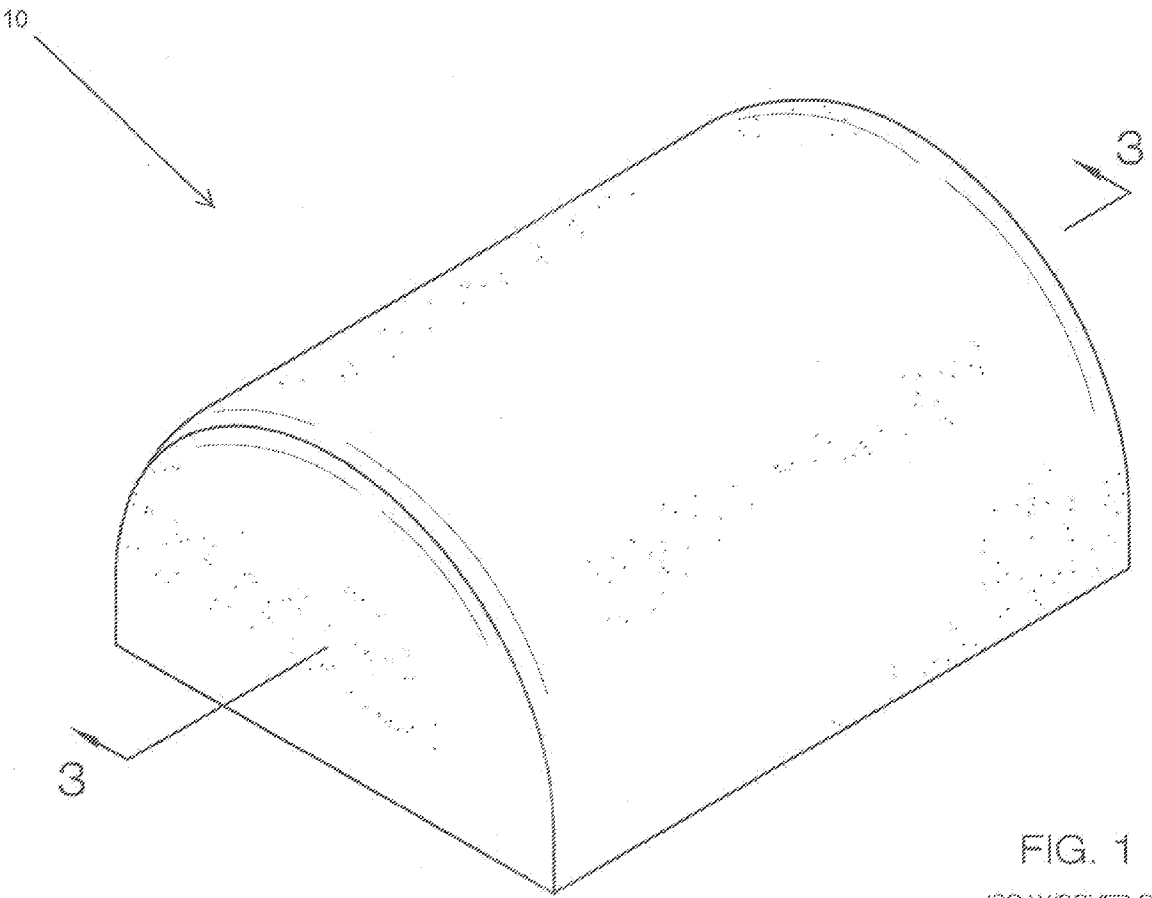
FIG. 1 is a ISO view of the present invention where the present invention is enclosed with a cover.

Referring now to FIGS. 1-6, the present invention features, in some broad embodiments an orthopedic pillow frame effective for facilitating the ideal position of the human head on a pillow while the body is at a resting position.

In some embodiments, the present invention features a primary arc 21 and an opposing complimentary arc 22, the primary arc 21 and the complimentary arc comprising, respectively, a primary arc middle point 23 and a complimentary arc middle point 24 at the peak heights of each arc, the primary arc 21 further comprising a primary arc first end 201 and a primary arc second end 203, the complimentary arc 22 further comprising a complimentary arc first end 202 and a complimentary arc second end 204.

The aforementioned arcs can comprise varying levels of arc degree in order to accommodate various embodiments which would be understood by one skilled in the art. In addition, the present invention could, in some embodiments, comprises arc heights of varying degree.

In some embodiments, the present invention features a first horizontal plane 31 and a second horizontal plane 32 where the second horizontal plane 32 is disposed at predetermined distance upwards from the first plane 31.

The first and second planes can function as marking points to identify the orientation of the additional components of the frame. As such the first and second planes can be of varying lengths from a bottom surface, such as the platform, and additional planes could be incorporated in order to vary the present invention as would be obvious to one skilled in the art.

In some embodiments, the present invention features a primary side bar 221 and an opposing complimentary side bar 222, the primary side bar 221 having first 223 and second 225 primary side bar ends, the complimentary side bar 222 having first 224 and second 226 complimentary side bar ends, wherein the first primary side bar end 223 makes contact with the primary arc first end 201 and where the second primary side bar end 225 makes contact with the complimentary arc first end 202, wherein the first complimentary side bar end 224 makes contact with the primary arc second end 203 and the second complimentary side bar end 226 makes contact with the complimentary arc second end 204, wherein the primary side bar 221 further comprises a first primary side bar corner edge 41 disposed at a predetermined length from the first primary side bar end 223, and a second primary side bar corner edge 43 disposed at the predetermined length from the second primary side bar end 225, wherein the complimentary side bar 222 further comprises a first complimentary side bar corner edge 42 disposed at the predetermined length from the first complimentary side bar end 224, and a second primary side bar corner edge 44 disposed at the predetermined length from the second complimentary side bar end 226, and wherein, starting from the first primary side bar corner edge 41 and the second primary side bar corner edge 43, the primary side bar 221 extends upwards and meets the second plane 32 at substantially middle portion of the primary side bar 221, wherein, starting from the first complimentary side bar corner edge 42 and the second complimentary side bar corner edge 44, the complimentary side bar 222 extends upwards and meets the second plane 32 at substantially middle portion of the complimentary side bar 222.

It would be understood by one skilled in the art that the primary and complimentary side bars could comprise various lengths in order to accommodate pillows of different sizes.

In some embodiments, the present invention features a primary inverted arc 61 and a complimentary inverted arc 62, the primary inverted arc 61 comprising a primary inverted arc first end 63 and a primary inverted arc second end 65, the complimentary inverted arc 62 comprising a complimentary inverted arc first end 64 and a complimentary inverted arc second end 66, wherein the primary inverted arc first end 63 makes contact with the primary arc 21 at a location between the middle point 23 of the primary arc 21 and the primary arc first end 201, the primary inverted arc second end 65 makes contact with the complimentary arc 22 at a location between the middle point 24 of the complimentary arc 22 and the complimentary arc first end 202, and wherein the complimentary inverted arc first end 64 make's contact with the primary arc 21 at a location between the middle point 23 of the primary arc 21 and the primary arc second end 203, the complimentary inverted arc second end 66 makes contact with the complimentary arc 22 at a location between the middle point 24 of the complimentary arc 22 and the complimentary arc second end 204, wherein the primary inverted arc 61 and the complimentary inverted arc 62 are in alignment such that the bars form a parallel channel 69 between the first 201 and second 203 ends of the primary arc 21 and the first 202 and second 204 ends of the complimentary arc 22, and wherein the primary inverted arc 61 and the complimentary inverted arc 62, at the lowest points of each arc, are flush with the second plane 32.

The aforementioned inverted arcs could, in some embodiments, comprise arcs of varying degrees and lengths in order to accommodate pillows of different shapes and sizes and in order to vary the frame.

In some embodiments, the present invention features a bottom platform 400, resting on the first plane 31, the platform 400 comprising a rectangular border wire and comprising first 411 and second 412 opposing wire sides and third 413 and fourth 414 opposing wire sides, the third wired side 413 further comprising primary 451 and complimentary 453 third wire side ends, the fourth wire side further comprising primary 452 and complimentary 454 fourth wire side ends, the third wire side 413 further comprising a third wire side primary edge 441 disposed at a second length from the primary third wire side end 451 and the third wire side further comprising a third wire side complimentary edge 443 disposed at the second length from the complimentary third wire side end 453, and the fourth wire side 414 further comprising a fourth wire side primary edge 442 disposed at the second length from the primary fourth wire side end 452 and the fourth wire side further comprising a fourth wire side complimentary edge 444 disposed at the second length from the complimentary fourth wire side end 454.

In some embodiments, the bottom platform can comprise varying sizes in order to accommodate pillows of different shapes and sizes. In some embodiments, the bottom platform can merely comprise a flat rectangular surface.

In some embodiments, the third wire side 413, at a substantially middle portion of the third wire side 413, makes contact with the primary inverted arc 61 at the second plane 32 and wherein the fourth wire side 414, at a substantially middle portion of the fourth wire side 414, makes contact with the complimentary inverted arc 62 at the second plane 32, and wherein the third wire side 413, at a substantially middle portion of the third wire side 413, makes contact with the primary side bar 221 at a at the second plane 32, and where the fourth wire side 414, at a substantially middle portion of the fourth wire side 414, makes contact with the complimentary side bar 222 at the second plane 32.

In some embodiments, the frame is configured to keep a human head, when rested on the frame, at a position effective for maximum sleep potential.

In some embodiments, the primary and complimentary arcs extend away from the first plane and in the same direction. In some embodiments the primary and complimentary arcs are of the same shape. In some embodiments, the primary inverted and complimentary inverted arcs are of the same shape.

In some embodiments, where the aforementioned components make contact, the components are secured via glue, welding, fasteners, or other mechanical means. In some embodiments, said components can be interconnected or part of one whole piece.

Figure 2:
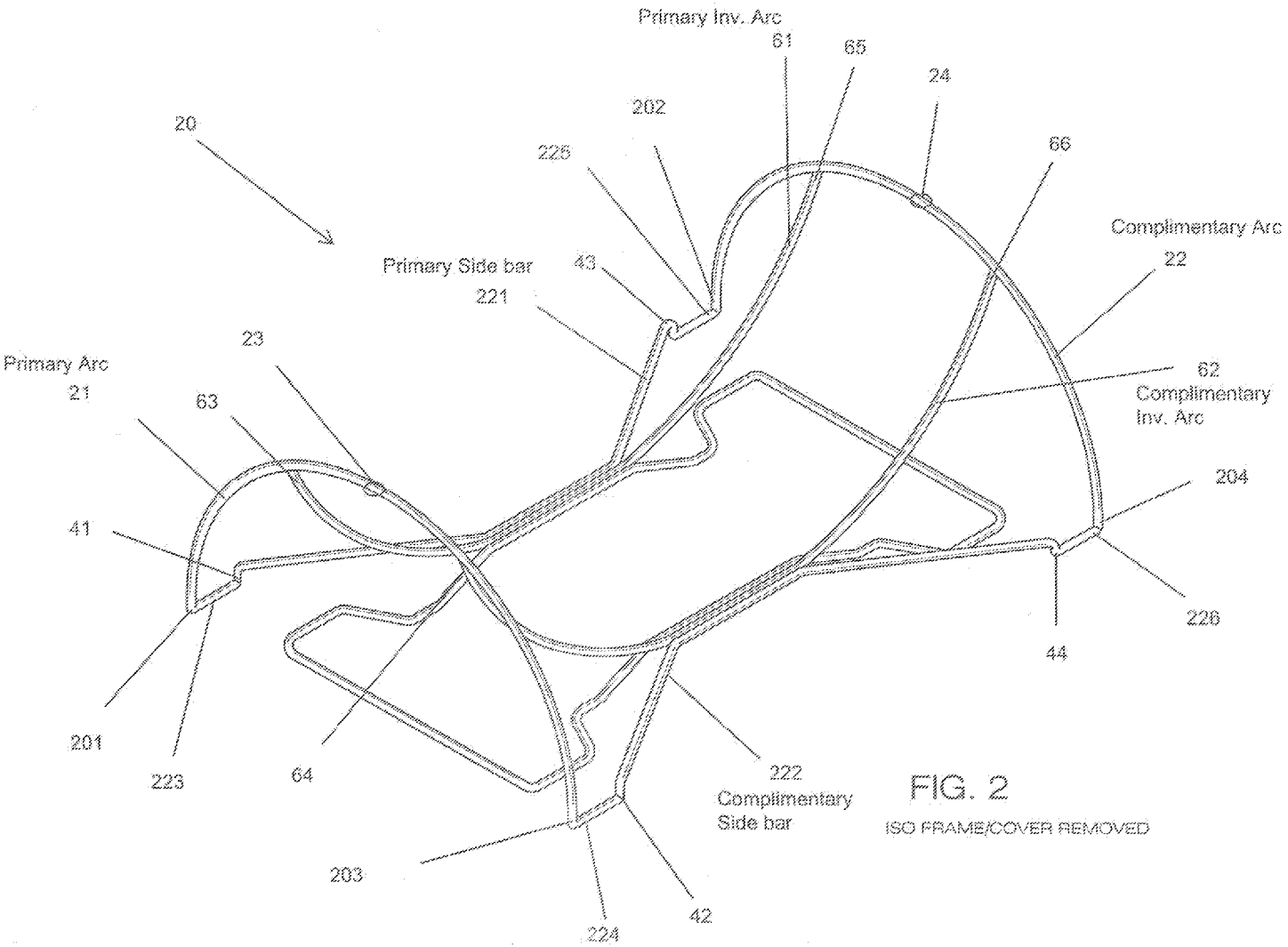
FIG. 2 is an ISO view of the present invention.
Figure 3:
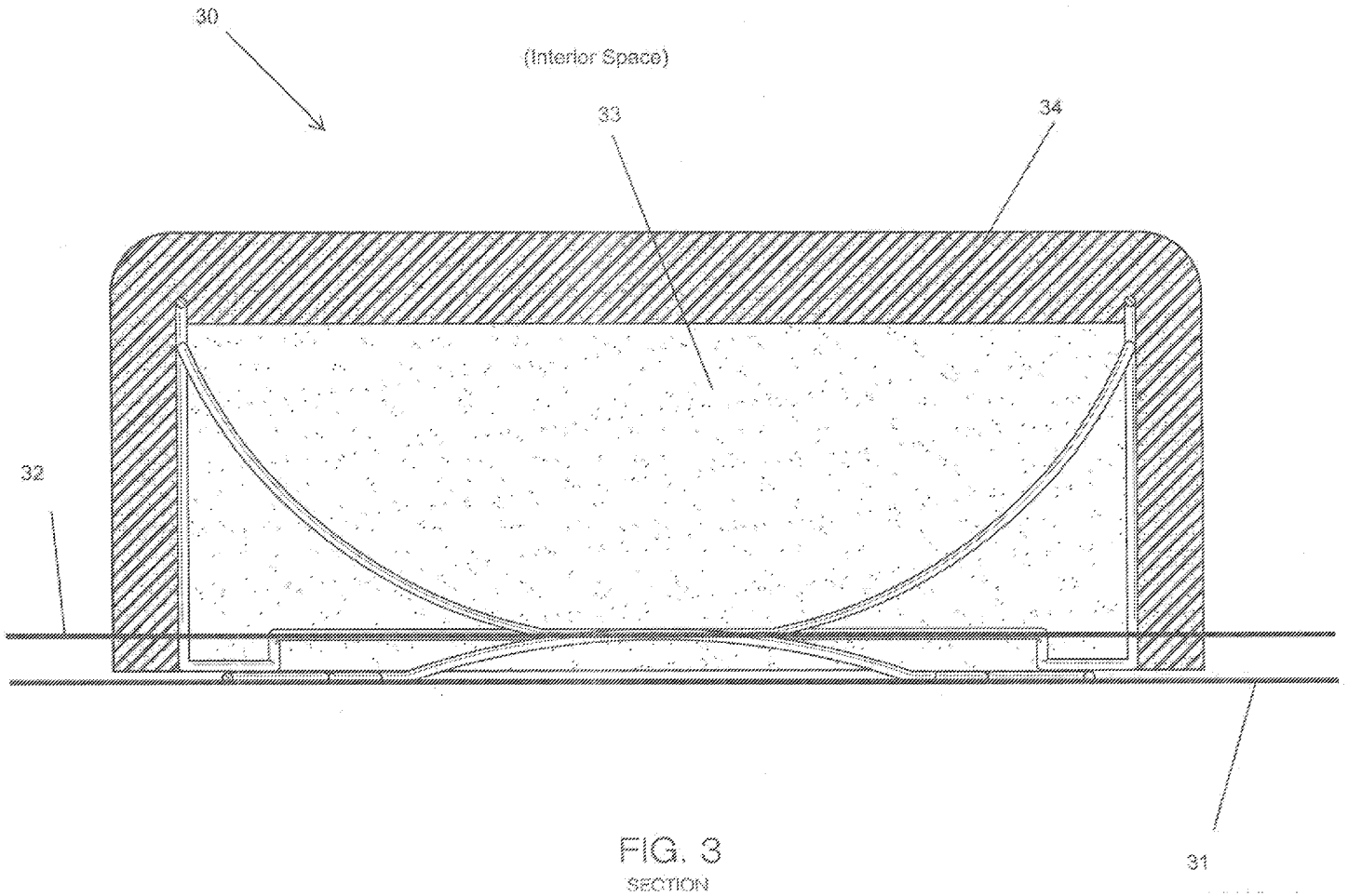
FIG. 3 is a section, side view of the present invention.
Figures 4, 5, 6:
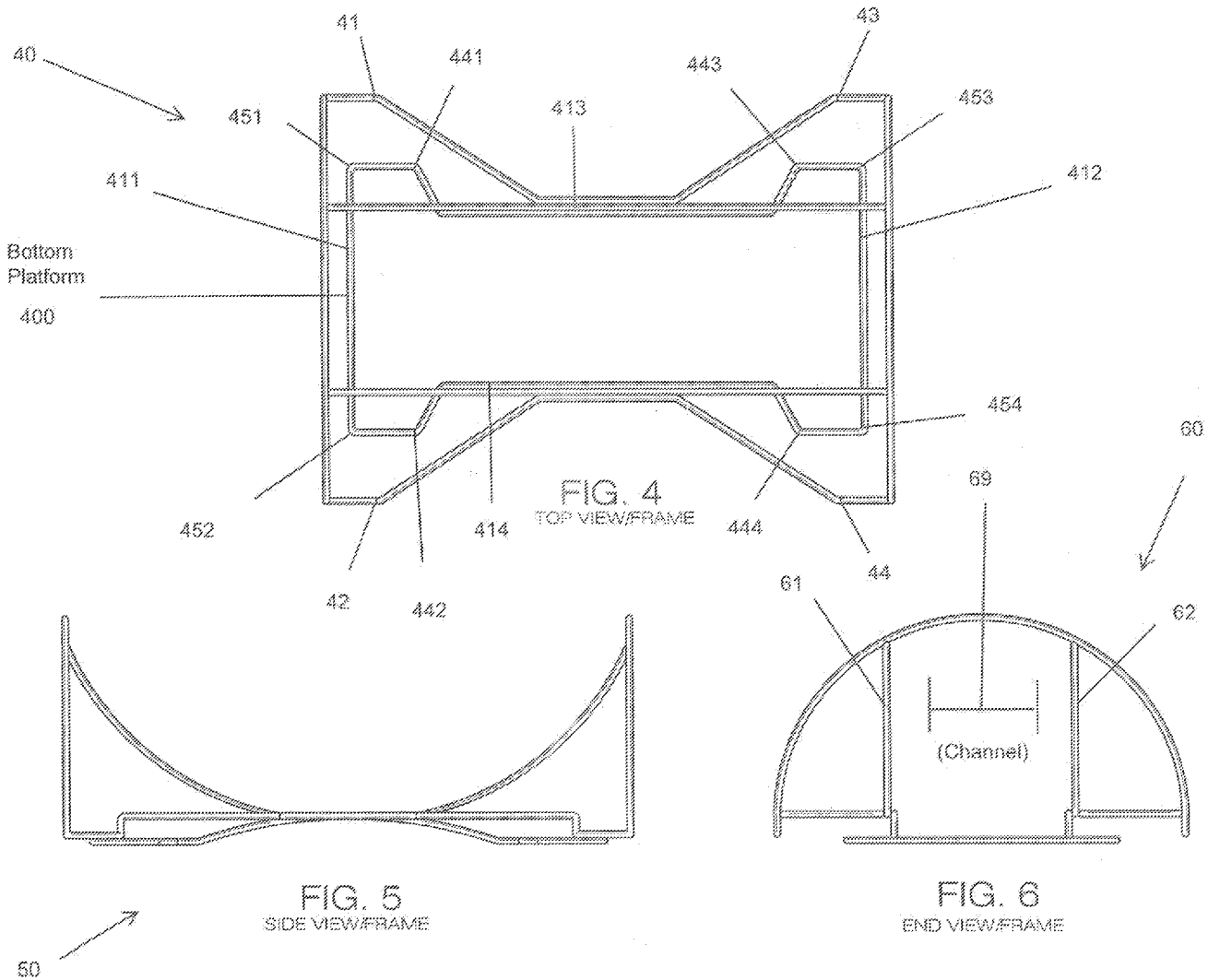
FIG. 4 is a top view of the frame of the present invention.
FIG. 5 is a side view of the frame of the present invention.
FIG. 6 is an end vie of the frame of the present invention.

In some embodiments, the primary arc middle point and the complimentary arc middle point are disposed on the respective arcs as follows. The primary and complimentary arcs can be divided into 100 equal units in length, where 0 units represents the arc at the first arc end, and 100 units represents the arc at the second end. As such, in some embodiments, the arc middle points can be disposed between 40 and 60 length units of the arc. FIG. 2 represents the present invention in some embodiments where the primary and complimentary arc middle points are disposed at around 50 units in length on both arcs.

In some embodiments, where the various components meet at the second plane, said components are in physical contact and fastened together with via welding, fasteners, glue, mechanical means, or are simply part of one piece.

In some embodiments, the various aforementioned components can comprise wire, metal, wood, plastic, or any other materials that would be suitable for the present invention and that would be recognized by one skilled in the art.

As used herein, the term "about" refers to plus or minus 10% of the referenced number.

As used herein, the term "about" refers to plus or minus 10% of the referenced number. For example, an embodiment wherein the device is about 10 inches in bar includes a device that is between 9 and 11 inches in bar.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An orthopedic pillow frame effective for facilitating the ideal position of the human head on a pillow while the body is at a resting position, the frame comprising:

a. a primary arc 21 and an opposing complimentary arc 22, the primary arc 21 and the complimentary arc comprising, respectively, a primary arc middle point 23 and a complimentary arc middle point 24 at the peak heights of each arc, the primary arc 21 further comprising a primary arc first end 201 and a primary arc second end 203, the complimentary arc 22 further comprising a complimentary arc first end 202 and a complimentary arc second end 204;

b. a first horizontal plane 31 and a second horizontal plane 32 where the second horizontal plane 32 is disposed at predetermined distance between the first plane 31 and the primary 23 and complimentary 24 arc middle points, and wherein the primary arc first end 201, the primary arc second end 203, the complimentary arc first end 202, and the complimentary arc second end 204 lie on the first plane 31;

c. a primary side bar 221 and an opposing complimentary side bar 222, the primary side bar 221 having first 223 and second 225 primary side bar ends, the complimentary side bar 222 having first 224 and second 226 complimentary side bar ends, wherein the first primary side bar end 223 makes contact with the primary arc first end 201 and where the second primary side bar end 225 makes contact with the complimentary arc first end 202, wherein the first complimentary side bar end 224 makes contact with the primary arc second end 203 and the second complimentary side bar end 226 makes contact with the complimentary arc second end 204, wherein the primary side bar 221 further comprises a first primary side bar corner edge 41 disposed at a predetermined length from the first primary side bar end 223, and a second primary side bar corner edge 43 disposed at the predetermined length from the second primary side bar end 225, wherein the complimentary side bar 222 further comprises a first complimentary side bar corner edge 42 disposed at the predetermined length from the first complimentary side bar end 224, and a second primary side bar corner edge 44 disposed at the predetermined length from the second complimentary side bar end 226, and wherein, starting from the first primary side bar corner edge 41 and the second primary side bar corner edge 43, the primary side bar 221 extends upwards and meets the second plane 32 at substantially middle portion of the primary side bar 221, wherein, starting from the first complimentary side bar corner edge 42 and the second complimentary side bar corner edge 44, the complimentary side bar 222 extends upwards and meets the second plane 32 at substantially middle portion of the complimentary side bar 222;

d. a primary inverted arc 61 and a complimentary inverted arc 62, the primary inverted arc 61 comprising a primary inverted arc first end 63 and a primary inverted arc second end 65, the complimentary inverted arc 62 comprising a complimentary inverted arc first end 64 and a complimentary inverted arc second end 66, wherein the primary inverted arc first end 63 makes contact with the primary arc 21 at a location between the middle point 23 of the primary arc 21 and the primary arc first end 201, the primary inverted arc second end 65 makes contact with the complimentary arc 22 at a location between the middle point 24 of the complimentary arc 22 and the complimentary arc first end 202, and wherein the complimentary inverted arc first end 64 makes contact with the primary arc 21 at a location between the middle point 23 of the primary arc 21 and the primary arc second end 203, the complimentary inverted arc second end 66 makes contact with the complimentary arc 22 at a location between the middle point 24 of the complimentary arc 22 and the complimentary arc second end 204, wherein the primary inverted arc 61 and the complimentary inverted arc 62 are in alignment such that the bars form a parallel channel 69 between the first 201 and second 203 ends of the primary arc 21 and the first 202 and second 204 ends of the complimentary arc 22, and wherein the primary inverted arc 61 and the complimentary inverted arc 62, at the lowest points of each arc, are flush with the second plane 32;

e. a bottom platform 400, resting on the first plane 31, the platform 400 comprising a rectangular border wire and comprising first 411 and second 412 opposing wire sides and third 413 and fourth 414 opposing wire sides, the third wired side 413 further comprising primary 451 and complimentary 453 third wire side ends, the fourth wire side further comprising primary 452 and complimentary 454 fourth wire side ends, the third wire side 413 further comprising a third wire side primary edge 441 disposed at a second length from the primary third wire side end 451 and the third wire side further comprising a third wire side complimentary edge 443 disposed at the second length from the complimentary third wire side end 453, and the fourth wire side 414 further comprising a fourth wire side primary edge 442 disposed at the second length from the primary fourth wire side end 452 and the fourth wire side further comprising a fourth wire side complimentary edge 444 disposed at the second length from the complimentary fourth wire side end 454, wherein the third wire side 413, at a substantially middle portion of the third wire side 413, makes contact with the primary inverted arc 61 at the second plane 32 and wherein the fourth wire side 414, at a substantially middle portion of the fourth wire side 414, makes contact with the complimentary inverted arc 62 at the second plane 32, and wherein the third wire side 413, at a substantially middle portion of the third wire side 413, makes contact with the primary side bar 221 at a at the second plane 32, and where the fourth wire side 414, at a substantially middle portion of the fourth wire side 414, makes contact with the complimentary side bar 222 at the second plane 32, wherein the frame is configured to keep a human head, when rested on the frame, at a position effective for maximum sleep potential.

2. The frame of claim 1 wherein the frame is constructed from a material comprising metal, aluminum or plastic.

3. The frame of claim 1 wherein the frame is flexible.

4. The frame of claim 1 wherein the locations where the various components make contact are secured via glue, welding, fasteners, or other mechanical means.

5. The frame of claim herein the frame is enclosed with a cover 34 to form an interior space 33.

6. The cover 34 of claim 5 wherein the interior space 33 is filled with foam, padding, cloth or feathers.

7. The cover 34 of claim 5 wherein the cover 34 further comprises a padded inner layer underneath the cover 34.

* * * * *